US005257418A

United States Patent [19]

Jaskiewicz

[11] Patent Number: 5,257,418

[45] Date of Patent: Nov. 2, 1993

[54] SHOCK ABSORBING GLOVE

[76] Inventor: Eric M. Jaskiewicz, 14301 Thorpe La., Upper Marlboro, Md. 20772

[21] Appl. No.: 832,577

[22] Filed: Feb. 7, 1992

[51] Int. Cl.[5] ..... A41D 19/00

[52] U.S. Cl. ..... 2/20; 2/161.1; 2/161.6; 2/DIG. 3; 2/910; 2/917

[58] Field of Search ..... 2/161 A, 164, 20, 16, 2/18, 161 R, 159, 160

[56] References Cited

U.S. PATENT DOCUMENTS

| | | | |
|---|---|---|---|
| 450,717 | 4/1891 | Reach | 2/19 |
| 3,217,333 | 11/1965 | Sweet et al. | 2/18 |
| 4,067,063 | 1/1978 | Ettinger | 2/16 X |
| 4,168,063 | 9/1979 | Rowland | 273/54 B |
| 4,378,009 | 3/1983 | Rowley et al. | 2/24 X |
| 4,747,163 | 5/1988 | Dzierson | 2/161 A |
| 4,945,571 | 8/1990 | Calvert | 2/161 A X |
| 5,020,515 | 6/1991 | Mann et al. | 128/26 |
| 5,113,530 | 5/1992 | Smith | 2/161 A X |

FOREIGN PATENT DOCUMENTS

| | | | |
|---|---|---|---|
| 1618369 | 1/1991 | U.S.S.R. | 2/16 |
| 172823 | 12/1921 | United Kingdom | 2/16 |

*Primary Examiner*—Clifford D. Crowder
*Assistant Examiner*—Sara M. Current
*Attorney, Agent, or Firm*—Edmund M. Jaskiewicz

[57] ABSTRACT

A shock absorbing glove for sports and industrial activities having air or gas filled compartments on the palm portion to function as cushions to absorb shocks and impacts transmitted to the palm by an object gripped by the glove.

9 Claims, 3 Drawing Sheets

SHOCK ABSORBING GLOVE

The present invention relates-to a glove for absorbing shocks and impacts transmitted to the arm and upper body from an object gripped by the glove, more particularly, to such a glove having at least one air or gas filled compartment on the palm thereof to function as an air cushion.

Many forms and varieties of gloves have been provided to protect the hands of a person engaged in various sports and industrial activities. Such gloves are specially constructed for very specialized purposes which include baseball mits and gloves, hockey gloves, golf gloves, heavy duty heat-resistant gloves used in industry and gloves made of very tough and durable materials to protect the hand while handling rough or sharp objects. Gloves have also been deviced to protect the hands of bicyclists, particularly when engaged in the sport of mountain biking wherein bicycles are ridden over rough and irregular terrain far removed from smooth paths or roads. When riding bicycles in such rough terrain a series of shocks and impacts are transmitted through the handlebars to the palm of the rider. Considering that such bicyclists may be engaged in mountain bike races which may range up to 25 miles, the continuous impacts and shocks transmitted to the hands of a bicyclist will be a cause of physical fatigue and in many cases actual aches and pains suffered by the hands and arms.

It has been proposed to provide the palms of bicyclists gloves with padding or gel contained in specially formed compartments on the palm of the glove. However, padding is unsatisfactory because it is quickly impacted out of shape and subsequently does not cushion against the shock. Gel also is quickly impacted into a shape to conform to the hand and handlebar and is quickly compressed to the point that the gel will no longer function to absorb shocks. Also, the thickness of the padding and gel which was utilized in an attempt to absorb shocks interfered with movement and flexing of the hand such as to prevent proper gripping of the handlebars at all times. As a result, such gloves containing padding or gel quickly became ineffective after very short periods of use and would have to be replaced by new gloves. The constant replacement of such gloves became a very expensive procedure for bicyclists.

It has further been proposed to provide gloves with air filled compartments for the purposes of heat insulation and to improve gripping. U.S. Pat. No. 2,842,771 discloses an insulated glove in which the entire glove is encased with a sheet material in order to provide a layer of air around the entire glove in order to conserve heat generated by the body to conserve the warmth of the hand. However, this glove has the disadvantage that the air chamber completely surrounding the glove does not permit ready flexing of the hand and does not provide any shock absorbent characteristics for the palm since any air in the palm will be pressed to other portions of the glove to remove any shock absorbing characteristics from the palm.

The German Offenlegungsschrift De 3234790 Al shows a glove in which there is an air chamber on the back of the hand which is so constructed that when the chamber is filled with air the glove is forced into a curled position to assist in gripping of a ski hole. The glove does not have a shock absorbing cushion in the palm of the glove.

The Russian patent 1319816 Al also discloses a glove having an air filled chamber thereon but this glove does not employ an air cushion on the palm thereof to absorb shocks transmitted to the hand. Thus, the known prior art has not disclosed or even suggested the concept of utilizing gas or air filled cushions on the palm of a flexible glove in sporting or industrial activities for the purpose of transmitting shocks and other forces transmitted by an object gripped by the wearer of the glove. At the same time, the glove is sufficiently flexible so as to conform readily with the shape of the hand in performing any gripping operations contemplated by the user.

It is therefore the principal object of the present invention to provide a novel and improved glove for the absorption of shocks and impacts from an object being gripped by the glove.

It is another object of the present invention to provide such a glove which is suitable for various sporting and industrial activities.

It is a further object of the present invention to provide a glove having a plurality of gas filled cushions on the palm thereof to absorb shocks and impacts.

It is still another object of the present invention to provide a shock absorbing glove having resilient cushions on the palm thereof which will continue to retain their shock absorbing properties for long periods of time without the necessity of being replaced.

According to one aspect of the present invention, a shock absorbing glove comprises a flexible layer which convers the palm and at least adjoining portions of the fingers and back of the hand and at least one gas-impermeable compartment is formed or attached on the palm portion of the flexible layer. Means are then provided on the glove for supplying air or other gas under pressure to the compartment such that the compartment would have a predetermined air pressure to define a cushion which will absorb shocks and impacts from an object being gripped by the glove. The glove may further, include a second flexible layer attached to the palm portion of the first layer and a plurality of transversely extending seam lines may be formed between the layers so as to define a predetermined pattern of compartments on the palm portion of the glove. These compartments are then supplied with air to define a plurality of air cushions which may be shaped to conform to the shape of the hand of the user.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
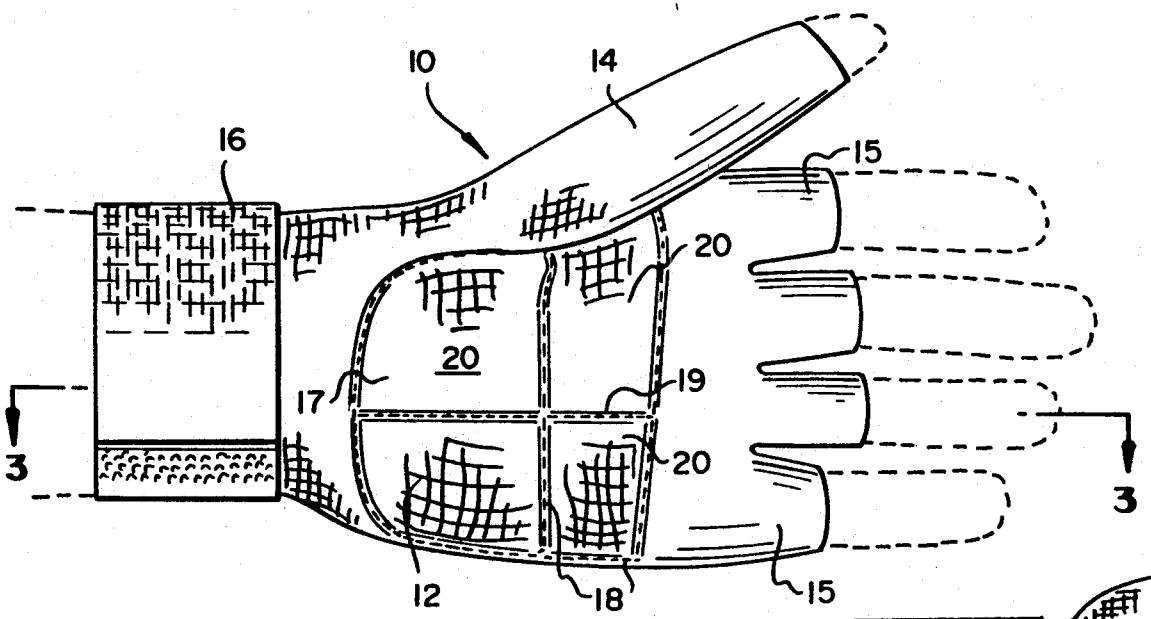
FIG. 1 is a plan view of the palm of a glove according to the present invention with transversely extending air cushions.
Figure 2:
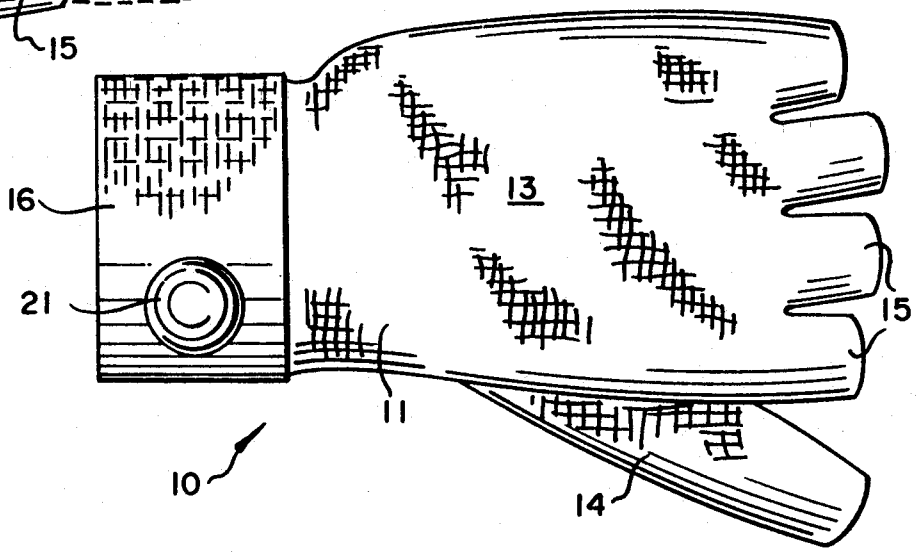
FIG. 2 is a plan view of the back of the glove and showing an air pump thereon.

As may be seen in FIG. 1, a shock absorbent glove according to the present invention is indicated generally at 10 and comprises a thin flexible layer 11 which covers the palm to define a palm portion 12 and the back of the hand at 13. The flexible layer also has a thumb portion 14 which covers at least an adjoining portion of the thumb and finger portions 15 which cover adjoining portions of the fingers. This thin flexible layer 11 may be made of a suitable material such as a synthetic leather or may comprise a synthetic leather palm portion and a fabric back portion 13 on which may be formed a Velcro wrist closure 16.

A second thin flexible layer 17 is superimposed on and attached to the palm portion 12 of the first layer by a plurality of transversely extending seam lines 18 and longitudinal seam lines 19. The seam lines may be formed by adhesives, stitching or the layers of fabric may be fused by heat or chemical means to define the seam line. The inner surfaces of the second layer 17 and the palm portion 12 of the first layer have a coating or a synthetic plastic film thereon so as to define gas-impermeable coatings.

The seam lines 18 and 19 thus define a plurality of transversely extending compartments 20 as may be seen in FIG. 1. These compartments 20 are interconnected by small openings so as to permit the communication of gases between compartments but which would restrict the flow of gases from a compartment when pressure is applied to that compartment.

Figure 3:
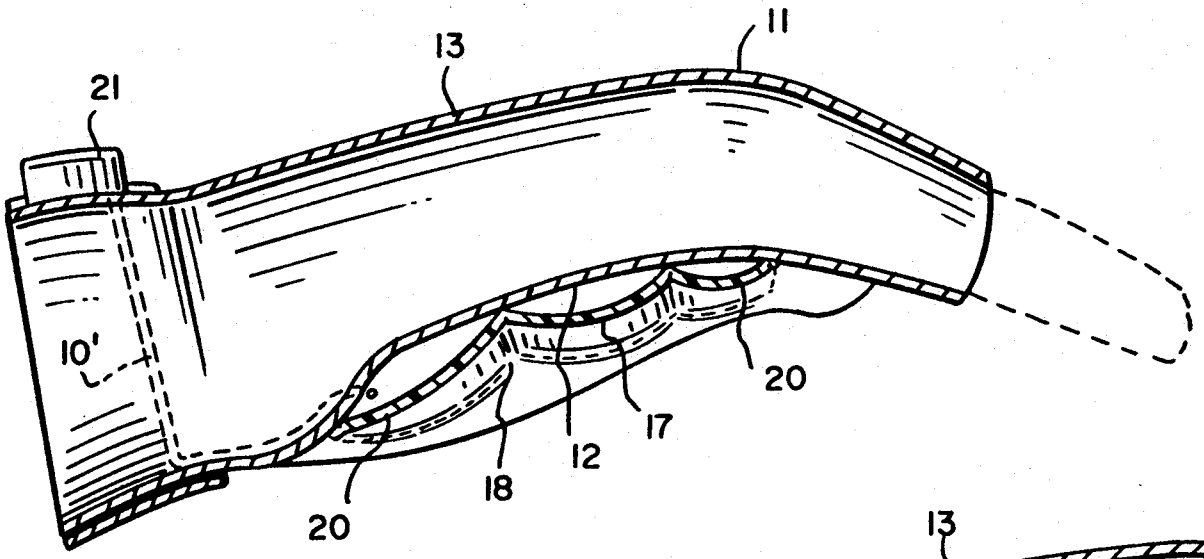
FIG. 3 is a longitudinal sectional view taken along the line 3—3 of FIG. 1.
Figure 3A:
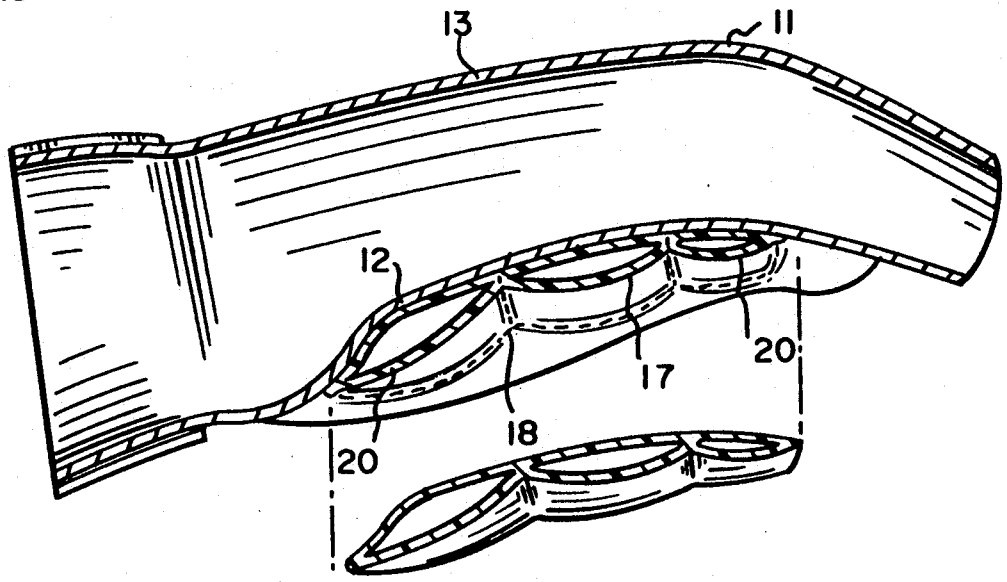
FIG. 3A is a view similar to that of FIG. 3 and shows the separate chamber or compartment.

A diaphragm pump 21 is attached to the Velcro wrist closure 16 and is connected by an air tube 10' to the nearest compartment 20 as shown in FIG. 3. The pump 21 may be similar to those pumps which are presently used on athletic shoes and are mounted on the tongues of these shoes or a syringe or ball pump may be used. In place of the pump 21 there may be provided a mouth piece such that air may be introduced into the compartments by blowing air from the mouth of the user. As a further alternative, the pump 21 may be provided with a nozzle for connection to a small canister of gas under pressure which gas can then be introduced into the nozzle as desired.

Upon the introduction of a suitable gas or air through the pump into the compartments 20, a plurality of air cushions will be formed on the palm of the glove and these air cushions will absorb shocks and impacts transmitted to the palm to an object which is gripped by the glove on the hand of the user.

Figure 4:
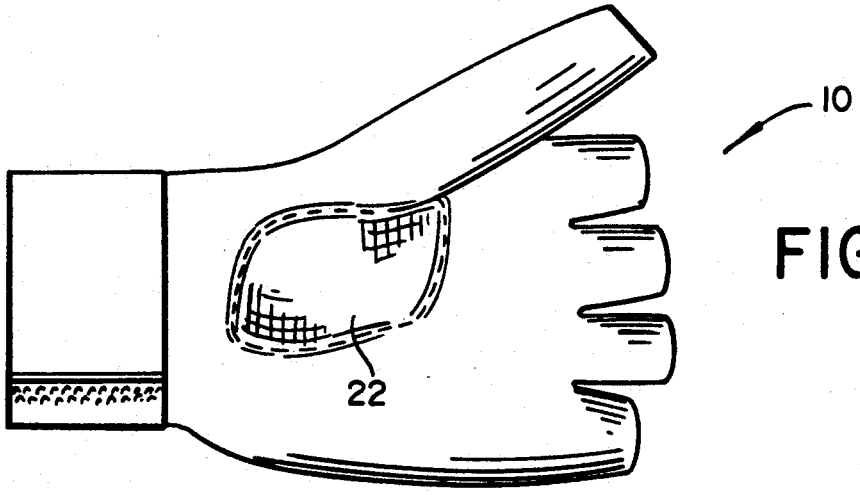
FIG. 4 is a plan view similar to that of FIG. 1 but showing a single air cushion at the base of the thumb.

Various arrangements of air compartments on the palm of a glove are possible depending on the sporting or industrial activity for which use of the glove is intended. In FIG. 4 there is shown a glove with a single air compartment 22 located at the base of the thumb on the palm of the hand. This is the region of the palm which absorbs considerable shocks or impacts when the glove is used by a bicyclist, particularly in mountain bike activities.

Figure 5:
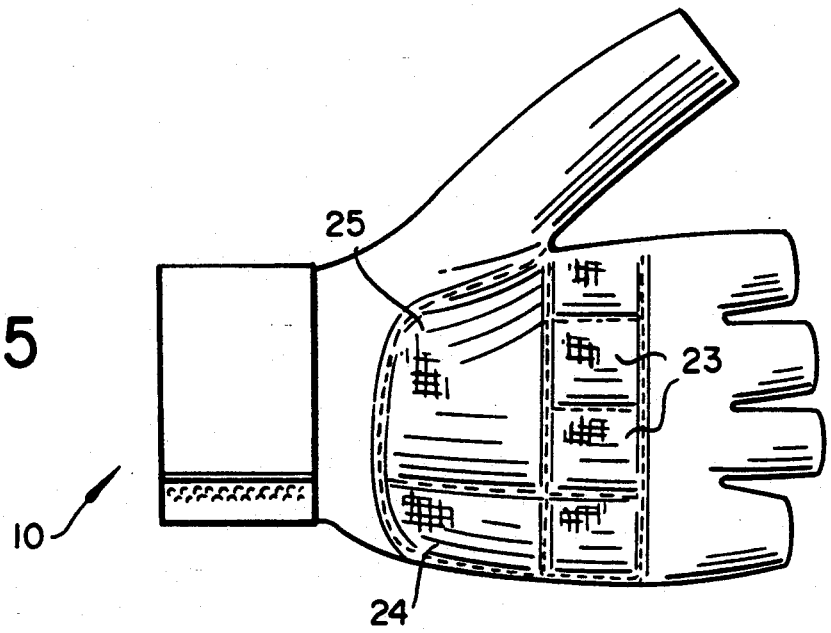
FIG. 5 is a plan view similar to that of FIG. 1 but showing a plurality of square, rectangular and irregularly shaped air cushions on the palm of the glove.

In FIG. 5 the glove is provided with a plurality of square compartments 23, a substantially rectangular compartment 24 and an irregularly shaped compartment 25 which essentially extends over the base of the thumb.

Figure 6:
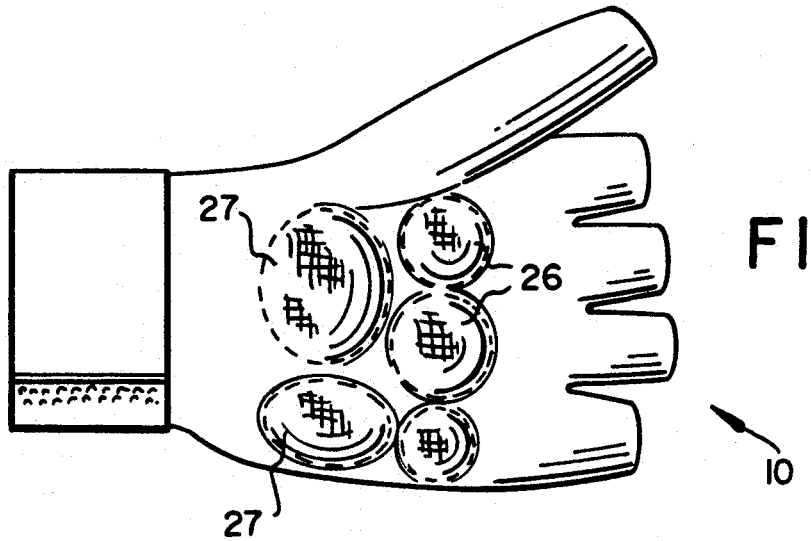
FIG. 6 is a plan view similar to that of FIG. 1 but showing the glove with a plurality of circular and elliptical air cushions on the palm thereof.

In FIG. 6 there is shown a glove having a plurality of circular compartments 26 and elliptical compartments 27.

A wide variety of random or irregular patterns of air cushions may be employed on the palm of the glove depending upon the use of the glove. Also, a regular or rectangular pattern of air cushions smaller in size than those illustrated in drawings of above may be positioned over the palm of the glove.

The air pressure introduced into the compartments is sufficient to permit flexing and bending of the hand but to absorb shocks and impacts. The specific air pressure employed will again depend on the personal desires of the user and the activity in which the glove is being used. The pump 21 is preferably provided with a check valve so that air introduced into the compartments on the palm of the hand will remain in the compartments.

The compartments may be separate and independent from each other and each can be filled separately with air or some other gas such as nitrogen, which is relatively inert, at different pressures depending on the use of the glove.

A glove according to the present invention may also be used in other sports such as in baseball and particuarly as a catcher's mit which has suitable arranged compartments inflated to a predetermined pressure in order to define a pocket in the palm of the glove.

In industry, the glove according to the present invention is advantageously used by workers who operate pneumatic powered machines and tools such as would be found on assembly lines or in various production operations. The use of such air cushion shock absorbing gloves may tend to alleviate aches and pains in the hands, fingers and wrists which may lead to more serious physical problems such as carpal tunnel syndrome. The glove may also be used by operators of jackhammers which are operated pneumatically and when using power impacting hand tools such as various forms of hammers, sledges, and the like.

In a further modification, the glove may also comprise a separable or independent air or gas filled bladder or compartment which is attached to the palm of the glove as shown in FIG. 3. Such a bladder type compartment may be any of the shapes as disclosed in the foregoing material or some other particular shape intended for a specialized application. The bladder or separate compartment is then attached in the appropriate position on the palm of the glove by stitching, adhesives, heat seams or other appropriate attaching means, depending on the materials of the glove and bladder compartment. In this manner, it is intended that the compartment be filled to the desired pressure and then assembled to the palm of the glove. It is quite feasible that these compartments can be removed from the glove should the pressure become too low and the compartment then can be replaced by a new compartment filled with an appropriate gas to a predetermined pressure. In actual practice, such compartments should retain their initial pressure for periods of 2–3 years or even longer. The compartments may also be detachably attached to the palm such as by the use of Velcro or some other readily detachable fastening structure.

The bladder or air filled compartment or chamber can be made gas impermeable by practices which are known in the art.

It is thus apparent that the present invention has disclosed a novel and effective glove employing one or more air or gaseous cushions on the palm thereof for the absorbing of shocks and impacts encountered in a wide variety of sporting and industrial activities. The arrangement and size of the compartments on the palm of the glove may be varied according to specialized activities which tend to produce localized or concentrated impacts or shocks on one part of the palm of the hand. Since the compartments can be maintained at a desired air pressure merely by introducing renewed amounts of air through the pump or other sources as described above, the gloves would have a long and useful operating life. Further, the air compartments can be maintained at predetermined temperatures without the necessity for continuously buying new gloves such as would be the case with gloves having padding or gel in the palm thereof.

It will be understood that this invention is susceptible to modification in order to adapt it to different usages and conditions, and accordingly, it is desired to comprehend such modifications within this invention as may fall within the scope of the appended claims.

What is claimed is:

1. A shock absorbing glove comprising a first thin flexible layer covering the palm and at least adjoining portions of the fingers and back of a hand, a second thin flexible layer superimposed on and attached to the palm portion of said first layer, means on the inner adjoining surfaces of said first and second layers to define a gas-impermeable coating thereon, a plurality of transversely extending seam lines between said first and second layers to define a plurality of transversely disposed compartments therebetween on the palm portion, and means on said glove for supplying air under pressure to said compartments such that said compartments have a predetermined air pressure therein to define a plurality of air cushions which will absorb shocks and impact from an object being gripped by said gloves, said air cushions are shaped and disposed to conform to the bending of the hand when gripping an object.

2. A shock absorbing glove as claimed in claim 1 and further comprising a plurality of longitudinally extending seam lines between said first and second layers to define with said transverse seam lines a pattern of longitudinal and transverse compartments.

3. A shock absorbing glove as claimed in claim 2 wherein said longitudinal and transverse seam lines define a rectangular pattern of compartments.

4. A shock absorbing glove as claimed in claim 2 wherein said longitudinal transverse seam lines define an irregular pattern of compartments.

5. A shock absorbing glove as claimed in claim 1 wherein said air cushions are square in shape.

6. A shock absorbing glove as claimed in claim 1 wherein said air cushions are circular in shape.

7. A shock absorbing glove as claimed in claim 1 wherein said air cushions are elliptical in shape.

8. A shock absorbing glove as claimed in claim 1 wherein one of said air cushions is positioned over the base of the thumb on the palm portion and shaped to conform to said thumb base.

9. A shock absorbing glove as claimed in claim 1 wherein said seams have openings therein to provide communication between predetermined adjoining compartments.

* * * * *